US005187474A

United States Patent [19]

Kielb et al.

[11] Patent Number: 5,187,474

[45] Date of Patent: Feb. 16, 1993

[54] DIGITAL CONVERTER APPARATUS FOR IMPROVING THE OUTPUT OF A TWO-WIRE TRANSMITTER

[75] Inventors: John A. Kielb; Richard L. Nelson, both of Eden Prairie; David L. Pederson, Hopkins, all of Minn.

[73] Assignee: Rosemount Inc., Eden Prairie, Minn.

[21] Appl. No.: 188,110

[22] Filed: Apr. 28, 1988

Related U.S. Application Data

[63] Continuation of Ser. No. 914,648, Oct. 2, 1986, abandoned.

[51] Int. Cl.[5] ..... G08C 19/16; G08C 19/10

[52] U.S. Cl. ..... 340/870.18; 340/870.37

[58] Field of Search ..... 340/870.34, 870.37, 340/310 A, 870.19, 310 R, 646, 870.18; 364/571, 573, 571.01; 324/60 R, 61 R

[56] References Cited

U.S. PATENT DOCUMENTS

| | | | |
|---|---|---|---|
| 3,646,538 | 2/1972 | Frick | 340/200 |
| 4,033,188 | 5/1975 | Herzl | 73/861.24 |
| 4,053,714 | 10/1977 | Long | 340/870.19 |
| 4,250,490 | 2/1981 | Dahlke | 340/370.37 |
| 4,403,296 | 9/1983 | Prosky | 364/573 |
| 4,403,297 | 9/1983 | Tivy | 364/579 |
| 4,419,619 | 12/1983 | Jindrick et al. | 340/646 |
| 4,437,164 | 3/1984 | Branch | 364/571 |
| 4,494,183 | 1/1985 | Bayer et al. | 364/154 |
| 4,520,488 | 5/1985 | Houvig et al. | 340/370.39 |
| 4,549,180 | 10/1985 | Masuda | 340/870.04 |
| 4,556,866 | 12/1985 | Gorecki | 340/310 A |
| 4,586,108 | 9/1986 | Frick | 340/370.37 |
| 4,598,381 | 7/1986 | Cucci | 364/558 |
| 4,607,247 | 8/1986 | Sterling | 340/370.39 |

OTHER PUBLICATIONS

"Rosemount Inc.'s Instruction Manual for the Model 1151DP Alphaline ® Differential and High Differential Pressure Transmitters," Model 1151DP/HiDP, FIGS. 4—4, 4-7, pp. 4-10, 4-15.

*Primary Examiner*—Alvin E. Oberley
*Assistant Examiner*—Kara Farnandez
*Attorney, Agent, or Firm*—Kinney & Lange

[57] ABSTRACT

An existing analog two-wire transmitter has a sensor module, an analog excitation circuit, and an analog detector circuit which provides an output representative of a sensed process variable, such a pressure, to a two-wire current loop. The analog detection circuit is removed and replaced with apparatus including a digital converter that digitally calculates the transmitter's output. The output is improved by calculating correction for linearity. The analog excitation circuit may also be replaced with a replacement excitation circuit. The replacement excitation circuit and the digital converter can be energized in series to control energization current. A charge pump can be coupled to the loop to balance the current in the series circuit. The digital converter can also provide electrical span and zero adjustments.

24 Claims, 7 Drawing Sheets

COMMUNICATION MEANS
UTILIZATION DEVICE
REGULATOR
CURRENT CONTROL
CALCULATING MEANS
CONSTANT
SENSOR MODULE
ANALOG CIRCUIT
EXCITATION MEANS
PROCESS VARIABLE
500
502
503
504
505
506
507
508
510
512
514
516
518
520
522
524
526
527
528
529
530
532
533
534
536
540
542
544
546
548
550
552

DIGITAL CONVERTER APPARATUS FOR IMPROVING THE OUTPUT OF A TWO-WIRE TRANSMITTER

This is a continuation of application Ser. No. 914,648, filed Oct. 2, 1986, now abandoned.

BACKGROUND OF THE INVENTION

1. Field of the Invention

The present invention relates to digital converter apparatus for improving the output of a two-wire transmitter sensing a process variable.

2. Summary of the Invention

An existing analog two-wire transmitter comprises a sensor module means coupled to a process variable for sensing and for providing a sensor output as a function of the process variable. The existing transmitter further comprises excitation means coupled to the sensor module means for providing excitation thereto. The existing transmitter further comprises analog detector means for providing analog conversion of the sensor signal to a two-wire transmitter output representative of the sensed process variable. The existing transmitter is modified such that the transmitter's output is improved. The analog detector means are removed from the transmitter and replacement apparatus which digitally calculates the transmitter's output are disposed in the transmitter. The replacement apparatus receive the sensor output and provide linearity or other correction to the output. In a preferred embodiment, the existing excitation means are removed and the apparatus comprise replacement excitation means which are disposed in the transmitter and coupled to the sensor module means for providing excitation thereto. In a further preferred embodiment the sensor module means comprises at least one capacitive sensor for sensing the process variable, rectification means coupled to the sensor output for providing rectification thereto, and analog correction means for providing analog corrections to the sensor.

In yet a further preferred embodiment, the apparatus comprises a microprocessor calculating output correction, span, and zero adjustments.

The existing transmitter can thus have its output improved while the transmitter remains in situ and coupled to the process variable and the loop. A transmitter with a digitally corrected output is thus provided without replacement of the existing sensor module or decoupling of the transmitter from process lines or the two-wire loop.

BRIEF DESCRIPTION OF THE DRAWINGS

FIG. 3 is a block diagram of a first preferred embodiment of a transmitter according to this invention;

DETAILED DESCRIPTION OF THE PREFERRED EMBODIMENTS

Figure 1:
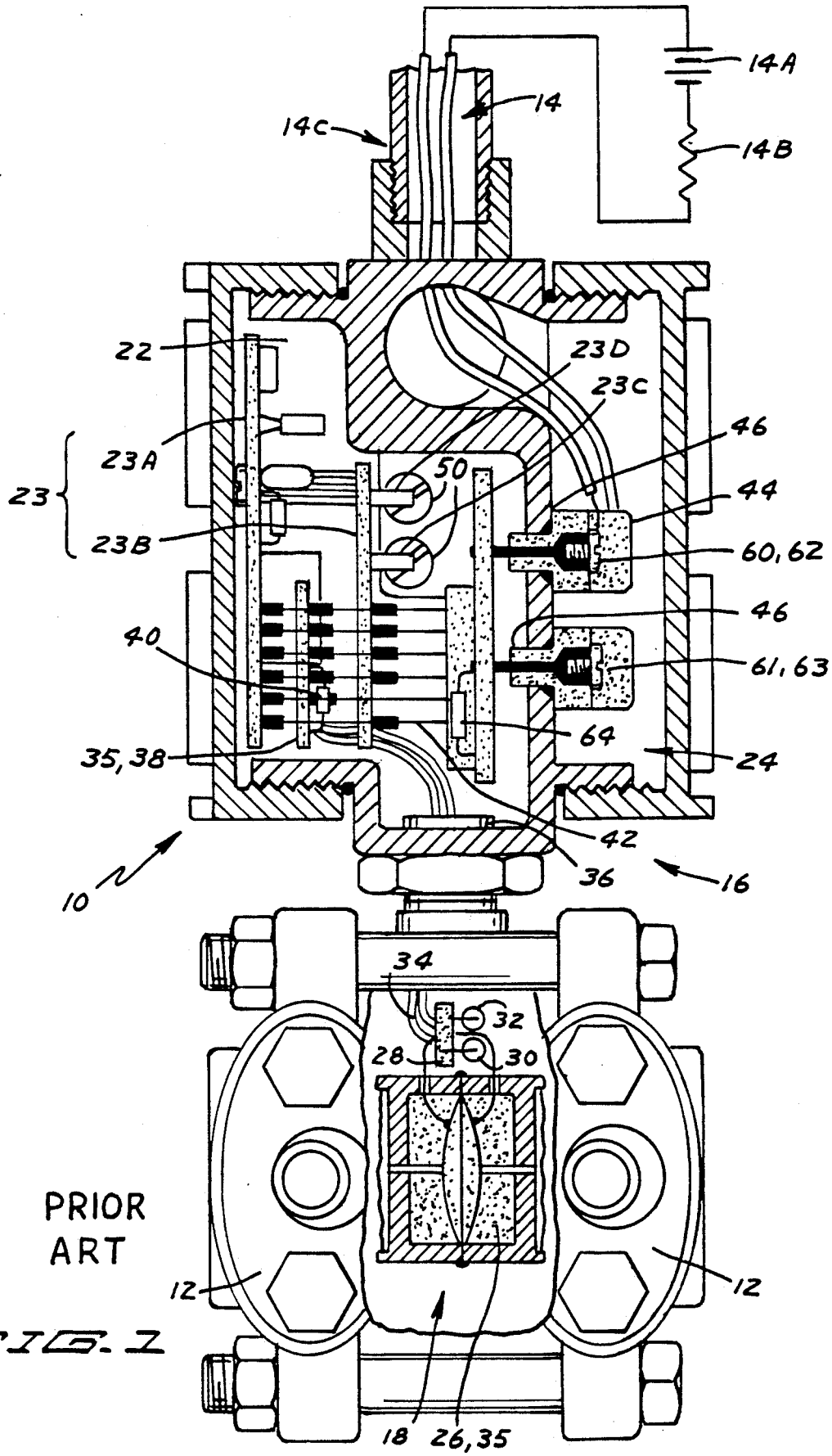
PRIOR ART FIG. 1
FIG. 1 is a drawing of a PRIOR ART analog transmitter showing a sectional view of an upper housing and a lower housing with parts broken away.

In FIG. 1, a PRIOR ART process variable transmitter 10 is shown bolted to flange adapter unions 12 which couple fluids to the transmitter 10. Transmitter 10 senses pressure of the fluids at flange adapter unions 12 and provides an output current representative of the sensed pressure to a two-wire loop 14. The transmitter 10 is energized by an external power supply 14A coupled to the two-wire loop and the output current such as a 4–20 milliampere signal is provided to an external load 14B which is also coupled to the two-wire loop 14. The transmitter 10 comprises a housing 16 which has three internal compartments 18, 22 and 24 which are sealed from one another. The transmitter 10 further comprises a capacitive pressure sensor 26 disposed in the compartment 18 for sensing a process variable such as differential, gauge or absolute pressure. Sensor 26 is electrically coupled via wires to a circuit board assembly 28 in compartment 18 which comprises diodes or rectifiers 30 for rectifying the sensor's output and analog correction components 32 for correcting the sensor's output. The corrections include temperature compensation. A cable 34 passes through a seal 36 between compartments 18 and 22 and electrically couples the circuit board 28 to a connector board 38 in compartment 22. The connector board 38 comprises additional analog correction or compensation circuitry 40 which provides temperature correction of characteristics of the sensor 26. Connector board 38 mates with a multipin connector 42 providing connection to further transmitter circuitry.

In operation, the sensor 26, the circuit board assembly 28, the cable 34, and the connector board 38 together comprise a sensor module 35 in the transmitter 10 which senses the process variable and provides a sensor output to connector 42 which includes analog correction for temperature.

A terminal strip 44 in sealed compartment 24 provides connection to the two-wire loop 14 in a conduit 14C and has sealed electrical feedthroughs 46 coupling the two-wire circuit from compartment 24 to the compartment 22. Compartment 22 in the housing 16 is configured to accept an analog converter and excitation circuit assembly 23 which utilizes analog circuitry to excite the sensor and convert the sensor signal to a 4–20 milliampere output. Assembly 23 comprises a printed circuit board 23A comprising analog converter and excitation electronics coupled to connector 42 and printed circuit board 23B comprising span and zero adjustment circuitry coupled to board 23A. A pair of sealed adjustment screws 50 extend from the interior of compartment 22 to the exterior of the transmitter housing 16. The adjustment screws 50 provide adjustment of span and zero potentiometers 23C, 23D on the circuit board 23B. The analog converter provides a reliable, low cost means of providing the output, and the setting of span and zero is accomplished using potentiometers 23C, 23D. The mechanical adjustment of the potentiometers 23C, 23D may be subject to mechanical vibration which may alter the settings of span and zero. The potentiometers 23C, 23D can adjust the span and zero settings of the output to the adjustment and resolution capabilities of the potentiometers. Linearity of the 4–20 milliampere output of transmitter 10 as a function of the sensed pressure is improved by the analog correction circuitry of transmitter 10. While adjustments are provided in the analog converter, excitation or sensor module for such nonlinearity, the linearity achieved can be further improved by use of a digital circuit.

The investment in assembling and installing the transmitter 10 in a process plant is considerable, and the entire cost of such an installation of transmitter 10 would be lost if transmitter 10 were removed and replaced with a higher accuracy transmitter such as one using digital circuitry. When transmitter 10 is installed in a process plant, such as a chemical, petroleum or pulp and paper plant, complete replacement of transmitter 10 is a costly and time consuming process. If separate shut-off valves have not been provided in the pressure lines to flange adapter unions 12, at least a portion of the plant may need to be shut down to depressurize lines so that process fluid does not spill out from the flange adapter unions 12 when they are unbolted from the transmitter. If shut off valves are provided, they may need to be shut off while the transmitter is being replaced. Flange adapter unions 12 must be unbolted from the transmitter 10 and rebolted to a replacement transmitter. Seals between the flange adapter unions 12 must be inspected because there is a possibility of leaks when the flange adapter unions 12 are bolted to a replacement transmitter. After replacement of transmitter 10, a replacement transmitter frequently must have its pressure lines bled to remove air which has entered the line during replacement. Complete replacement of transmitter 10 requires disconnection of loop 14 from terminals 44 in the transmitter 10 and disconnection of conduit 14C from the transmitter 10. A replacement transmitter must next be recoupled to the loop 14 and conduit 14A. In some cases, it is not practical to shut down a portion of the process plant to replace a transmitter, and replacement of transmitter 10 is therefore delayed until a scheduled shutdown for maintenance. The process pipes coupling to flange adapter union 12 and the conduit 14C may be weakened by age, corrosion, or vibration; handling these lines during a complete replacement may damage some of these parts. If the transmitter is not completely replaced, but is instead upgraded with a digital converter replacing analog electronics in the transmitter 10, the cost and time of complete replacement can be avoided. When a digital replacement converter is used, it is possible to avoid disturbing the process itself, the pressure lines leading to the transmitter, the flange adapter union 12, the loop wiring 14, the terminal strip 44 and the conduit 14C. A digital converter, moreover, can comprise span and zero adjustment that is electrical; the use of potentiometers which may be sensitive to vibration is thus avoided. Electrical adjustments of span and zero can be accomplished with a higher resolution than the resolution of potentiometers, and can provide more accurate span and zero settings. A digital converter can further comprise digital linearity corrections that provide for a transmitter output which can have better linearity over a wider range. The major portions of transmitter 10 such as the housing, sensor module, including temperature compensation components, terminal strips and connections to the loop are adequate for use with a digital circuitry and the transmitter's performance can be improved with a high accuracy system. Accordingly, the analog converter 23 can be removed from transmitter 10 and the transmitter 10 can be improved to a desired level by installation of apparatus comprising a digital converter. Upgrading the transmitter with a digital converter avoids wasting the labor and materials invested in the original materials, assembly labor, analog compensation and installation in a process line. Span, zero and other adjustments are made to the digital converter without the use of potentiometers, and high stability and setability are thus achieved.

Figure 2:
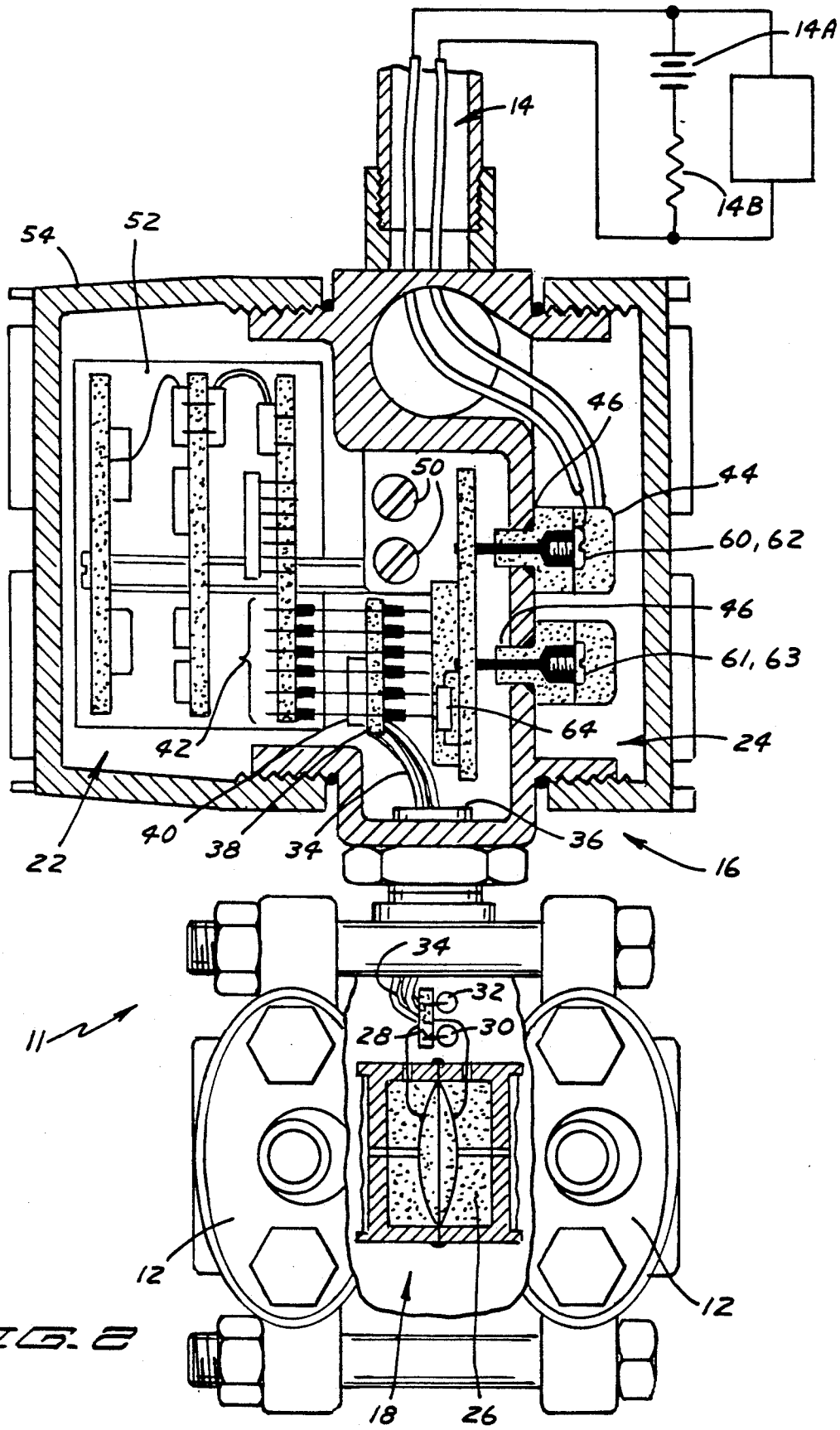
FIG. 2 is a drawing of a transmitter according to this invention showing a sectional view of an upper housing and a lower housing with parts broken away.
Figure 9:
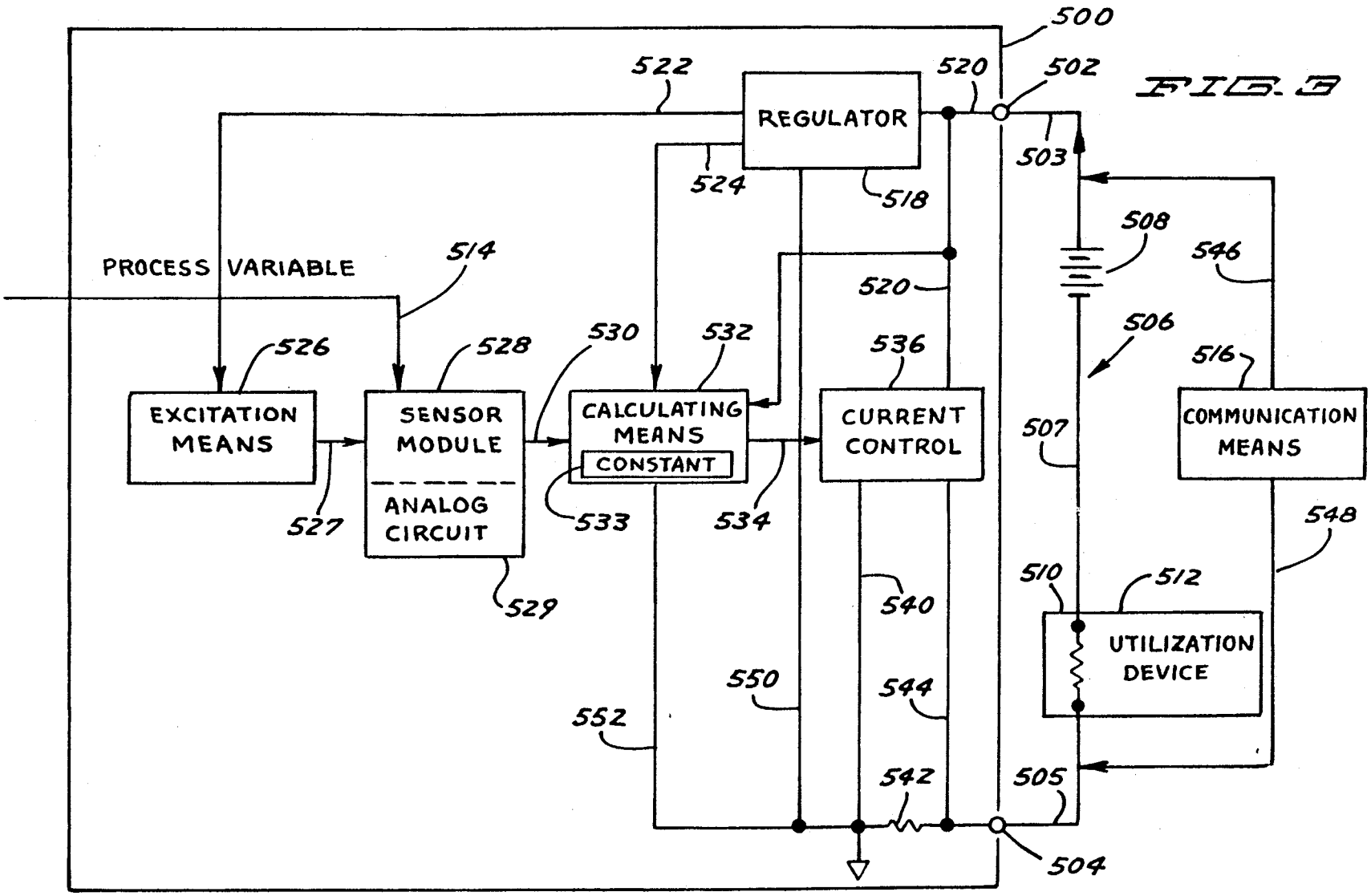

In FIG. 2, an exemplary transmitter 11 is shown which comprises such a digital converter. In FIG. 2, reference numerals which are the same as those in FIG. 1 identify corresponding features. In FIG. 2, a digital converter 52 is installed in transmitter 11, the assembly 23 having been previously removed from transmitter 11. The transmitter 11 thus has an output to the loop 14 which has an improved accuracy for interfacing with a control system via the loop. Converter 52 provides a second compensation or correction in addition to the analog correction done in the sensor module such that the transmitter output is improved to a desired level while avoiding the time, cost and inconvenience of replacing the entire transmitter.

The apparatus 52 is installed in the chamber 22 of the transmitter 11 and is thus sealed in the transmitter. The circuitry of apparatus 52 can be configured to control energy storage such that the intrinsic safety features of the transmitter are preserved.

FIG. 3 is a block diagram of a first embodiment of a transmitter 500 made according to this invention. The transmitter 500 couples to a process variable along a line 514. The process variable on line 514 can comprise absolute, gauge or differential pressure, temperature, pH, flow, conductivity or the like. The transmitter 500 senses the process variable on line 514 and provides an output as a function of the process variable. The transmitter 500 further comprises output terminals 502, 504 coupled to a two-wire loop 506 along lines 503 and 505 respectively. An energization source 508 couples in series with loop 506 between lines 503 and 507 and provides energization to transmitter 500. Transmitter 500 comprises a current control 536 coupled along line 520 to output terminal 502 and coupled along line 540 through a resistance 542 to output terminal 504. Current control 536 controls current I in loop 506 as a function of the sensed process variable and hence current I is a transmitter output. Current I is preferably a low frequency 4–20 milliampere current which is linearly proportional to the sensed process variable. Current control 536 is preferably also coupled along line 544 to output terminal 504 for sensing a potential developed across resistance 542. The potential thus developed is representative of loop current I. Current control 536 can thus monitor loop current I and provide closed loop control of loop current I. A resistance 510 is coupled between lines 505 and 507 in loop 506. The loop current I flows through resistance 510. A utilization device 512 coupled to resistance 510 uses a potential developed across resistance 510. Utilization device 512 can comprise a control computer, loop controller, chart recorder, meter or other indicating, recording or control apparatus.

The current control 536 can also generate a first communication output. The first communication output is preferably a high frequency, frequency-shift-keyed (FSK), serial signal. The keying or modulation frequency of the first communication output is preferably selected to be spaced from the low frequency of loop current I such that the first communication output can be superimposed on the loop current I without substantially interfering with the operation of utilization device 512. The first communication output comprises data representative of transmitter operation or installation parameters such as span and zero settings, serial number of the transmitter, identification of the process variable sensed, current magnitudes of the process variable and the like. The first communication output is coupled from current control 536 along lines 520, 540 to output terminals 502, 504 respectively. The first communication output is coupled from output terminals 502, 504 to lines 503, 505 respectively of loop 506. A communications means 516 is coupled along lines 546, 548 to lines 503, 505 respectively. Communication means 516 receive the first communication output from current control 536 along lines 520, 503, 546, 505 and 540. Communication means 516 thus receive the data comprised in the first communication output and provides such data to a user at a location which can be remote from the transmitter. Communication means 516 are preferably capacitively coupled to the loop 506 so that the low frequency loop current I does not flow through communication means 516. While the embodiment described in connection with FIG. 3 sends and receives communication signals over the loop, it will be understood by those skilled in the art that such communication signals can be alternately coupled to the transmitter over a line or bus which is separate from the loop.

Transmitter 10 further comprises a regulator 518 coupled to line 520 for receiving a portion of loop current I and for energizing further transmitter circuitry with controlled levels of energization. Regulator 518 couples energization along line 522 to excitation means 526 and couples energization along a line 524 to calculating means 532. The portion of loop current coupled to regulator 518 is returned to the loop along line 550 coupled between the regulator and line 540, and along line 552 coupled between the calculating means 532 and line 540.

The excitation means 526 generate an excitation output which is coupled along line 527 to a sensor module 528. The sensor module is coupled along line 514 to the process variable for sensing the process variable. The excitation output on line 527 excites the sensor module 528 and the sensor module 528 couples a sensor output along line 530 which is a function of the sensed process variable. The sensor module 528 further comprises an analog circuit 529 providing a correction to the sensor output on line 530. The correction provided by analog circuit 529 corrects for a response of the sensor output which deviates from a desired response of the sensor output to the sensed parameter. The correction provided by the analog circuit 529 can comprise a correction to the linearity of the sensor output as a function of the process variable; a temperature correction of a sensor output representing pressure, flow, conductivity; cold junction compensation for a thermocouple, or the like. In a preferred embodiment, sensor module 528 further comprises rectification means for rectifying the sensor output on line 530.

The sensor output on line 530 is coupled to calculating means 532. Calculating means 532 calculate a calculated output as a function of the sensor output. The calculated output is representative of a desired output such as the amplitude of current I in loop 506 and is a function of the sensed parameter. A constant 533 is stored in the calculating means. Constant 533 is representative of a digital correction to the transmitter output which improves the transmitter output beyond the correction provided by analog circuit 529. Constant 533 can comprise a linearity correction, a span correction, a zero correction or other correction which improves a characteristic of the transmitter's output. In a preferred embodiment, constant 533 comprises multiple corrections of linearity, span and zero settings. The calculated output is coupled along line 534 to current control 536. In a preferred embodiment, current control 536 compares the calculated output on line 534 to the sensed or actual current I sensed at line 544 and controls current on line 520 so that the actual current I is substantially equal to the calculated current I as represented by the calculated output on line 534. The transmitter's output is thus improved by both an analog and a digital correction. The current received by utilization device 512 is a better representation of the sensed parameter because a digital, correction has been made in transmitter 500.

In a preferred embodiment, the calculating means 532 also generates an output representative of the first communication output which is coupled along line 534 (along with the calculated output) to the current control 536. The current control 536 thus superimposes a current which is the first communication output on the loop current.

In a further preferred embodiment, the communications means 516 receives data representative of correction constants from a user. The communication means 516 couples a second communications output comprising correction constants on lines 546, 548 to lines 503, 505 respectively. The second communication signal is coupled along lines 503, 505 to output terminals 502, 504 respectively. In the transmitter 500, the second communication output is coupled from terminals 502, 504 through resistance 542 and along lines 552 and 520 to calculating means 532. Calculating means 532 receives the second communication signal and stores data contained therein as constant 533. Transmitter 500 can thus be provided with correction constant 533 from a remote location and it is not necessary to locate or open transmitter 500 to adjust the correction constants 533. The transmitter 500 in FIG. 3 utilizes the existing sensor module 528 in a transmitter and the replacement converter comprises calculating means 532, current control 536, regulator 518 and resistor 542. Replacement excitation means 526 can also be provided.

Figure 4:
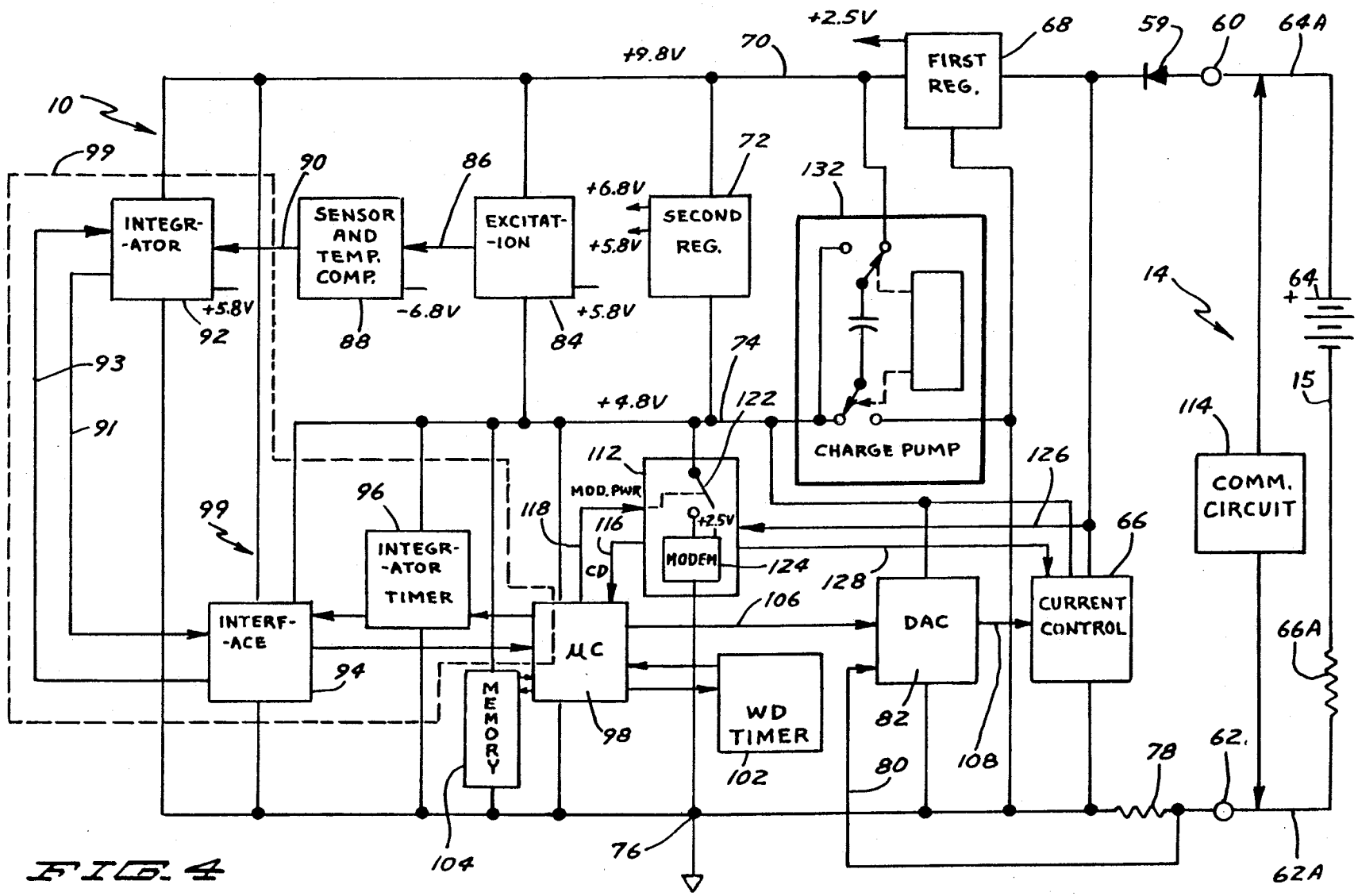
FIG. 4 is a block diagram of a second preferred embodiment of a transmitter according to this invention.

In FIG. 4, a block diagram of a second preferred embodiment of the circuitry in transmitter 10 is shown coupled to a two-wire, 4–20 milliampere loop 14. The transmitter 10 is coupled to the loop at terminals 60, 62 in transmitter 10. An energization source 64 such as a battery or power supply is coupled along line 15 in series with a loop load represented by resistance 66A. The loop load can comprise a control computer, a chart recorder, or current meter for example. A loop current flows from source 64 along line 64A into the transmitter at terminal 60 and out of the transmitter at terminal 62 along line 62A to resistance 66A, thus energizing transmitter 10 from the loop. A diode 59 in transmitter 10 provides reverse polarity protection to the transmitter 10. The amplitude of the low frequency loop current is controlled by current control 66 coupled to terminals 60, 62 such that the amplitude of the loop current is a function of the process variable sensed by the transmitter. A first regulator 68 is coupled to terminal 60 and provides a first regulated potential on line 70 in the transmitter 10. A second regulator 72 is coupled to line 70 and provides a second regulated potential to a line 74. Current flowing through the transmitter is returned to circuit common conductor 76 in the transmitter 10 and the common conductor is coupled to terminal 62 through a resistor 78. The potential developed across resistor 78 is representative of the actual loop current and this potential is coupled along line 80 back to a digital-to-analog converter (DAC) 82 to provide closed loop control of the transmitter output current. An excitation means 84 is energized from line 70, 74 and provides excitation along a line 86 to a sensor module 88. The sensor module 88 can comprise a capacitive pressure sensor, analog linearity and temperature compensating components, and rectification circuitry.

The sensor module 88 couples a sensor output as a function of the sensed parameter on line 90 to an integrator 92. Temperature compensation using analog techniques are performed in the sensor module 88. An interface circuit 94 is coupled to the integrator 92 along lines 91, 93 and interfaces the integrator circuit 92 to an integrator timer 96 and a microcomputer 98. The integrator 92 is energized from lines 70 and 76 and operates at higher potentials than timer 96 and microcomputer 98 which are energized from lines 74 and 76. Because of the difference in potential, the interface circuit provides level shifting to ensure compatible signal levels. The integrator 92, the interface circuit 94, and the integrator timer 96 operate in conjunction with the microcomputer 98 to form a dual slope type A-to-D converter 99. The dual slope type converter 99 performs an analog-to-digital conversion of the corrected analog sensor output from sensor module 88. The dual slope converter 99 thus presents a digital signal to microcomputer 98 which is representative of the sensor output corrected for temperature. The microcomputer 98 is preferably a single chip microcomputer having microprocessor, program memory and random access memory all on one integrated circuit to provide preferred low power consumption and small size. In another embodiment, microcomputer 98 can alternatively comprise separate microprocessor, program ROM and RAM if space and power specifications are compatible with the design. In one preferred embodiment, a "watchdog" timer 102 is coupled to the microcomputer 98 and senses when the microcomputer 98 fails to perform a selected task in a time limit set by the watchdog timer 102. Failure to perform the task in the time limit is an indication of malfunction of the microcomputer 98, and the watchdog timer resets the microcomputer when such failures occur. A non-volatile memory 104 coupled to microcomputer 98 has been loaded with constants which are representative of digital linearity corrections for the transmitter. The improved transmitter thus can provide digital corrections to the transmitter output in addition to the analog corrections which were made in the sensor module 88 when the transmitter was originally manufactured. The microcomputer 98 calculates a transmitter output based on the digital correction words stored in memory 104 and the calculated output is improved in accuracy over the accuracy of the original analog transmitter output. The calculated transmitter output is coupled along line 106 to the digital-to-analog (DAC) circuit 82. The DAC 82 compares the calculated output to the signal on line 80 which is representative of the actual loop current. The DAC 82 couples a signal along line 108 to the current control 66 so that the current in the loop is equal to the desired calculated transmitter output. A communication circuit 112 coupled to microcomputer 98 provides means for receiving digital words from the loop such as correction constants and span and zero settings for the transmitter. The communication circuit 112 in the transmitter is coupled along lines 126, 128, 62A, 64A for two-way communication circuit with a second communication circuit 114 which can be a part of a digital control system or can be a separate device coupled to the loop at a remote point. Data is entered into the second communication circuit 114 which represents span, zero and linearity corrections. The second communication circuit 114 couples a high frequency signal over loop conductors 62A, 64A and lines 76, 126 in the transmitter to the communication circuit 112. The high frequency signal is detected by the communication circuit 112 in the transmitter and a "carrier detect" signal is coupled from the communication circuit 112 to the microcomputer 98 along line 116. When the carrier detect signal is sensed, the microcomputer 98 couples a signal on line 118 to the communication circuit 112 which closes switch 122 and energizes a modem 124 in communication circuit 112. Modem 124 performs two-way communication with the second communication circuit 114 along lines 126, 128, 76, 62A, 64A. Correction constants are received by the modem 124 and are transferred to the memory 104 by microcomputer 98. Span and zero constants are likewise received and stored in the memory 104. The modem 124 transmits to the second communication circuit 114 data representative of the status of constants stored in memory 104 which may include parameters controlling transmitter function, serial numbers and maintenance history as well as data representative of the process variable.

The combined energization currents for the circuitry can exceed the 4 milliampere energization level available from the loop. The excitation circuit 84 and the microcomputer 98 are coupled in series so that the same current flows through both and total energization current from the loop is effectively controlled. A charge pump 132 can be coupled between conductors 70, 74 and 76 to further reduce the excitation current at the loop terminals. The charge pump transfers charge between the series loads so that the current requirements of the two series energization circuits are better balanced. This further reduces energization current at the transmitter terminals. Switch 122 is open during normal operation of the transmitter so that the modem does not operate, further reducing energization requirements. The energization current to the transmitter from the loop can thus be kept below 4 milliamperes and hence the transmitter can be operated from the 4–20 mA loop 14. During periods of communication between modem 124 and circuit 114, however, excitation current consumption may temporarily exceed 4 mA.

Figure 5A:
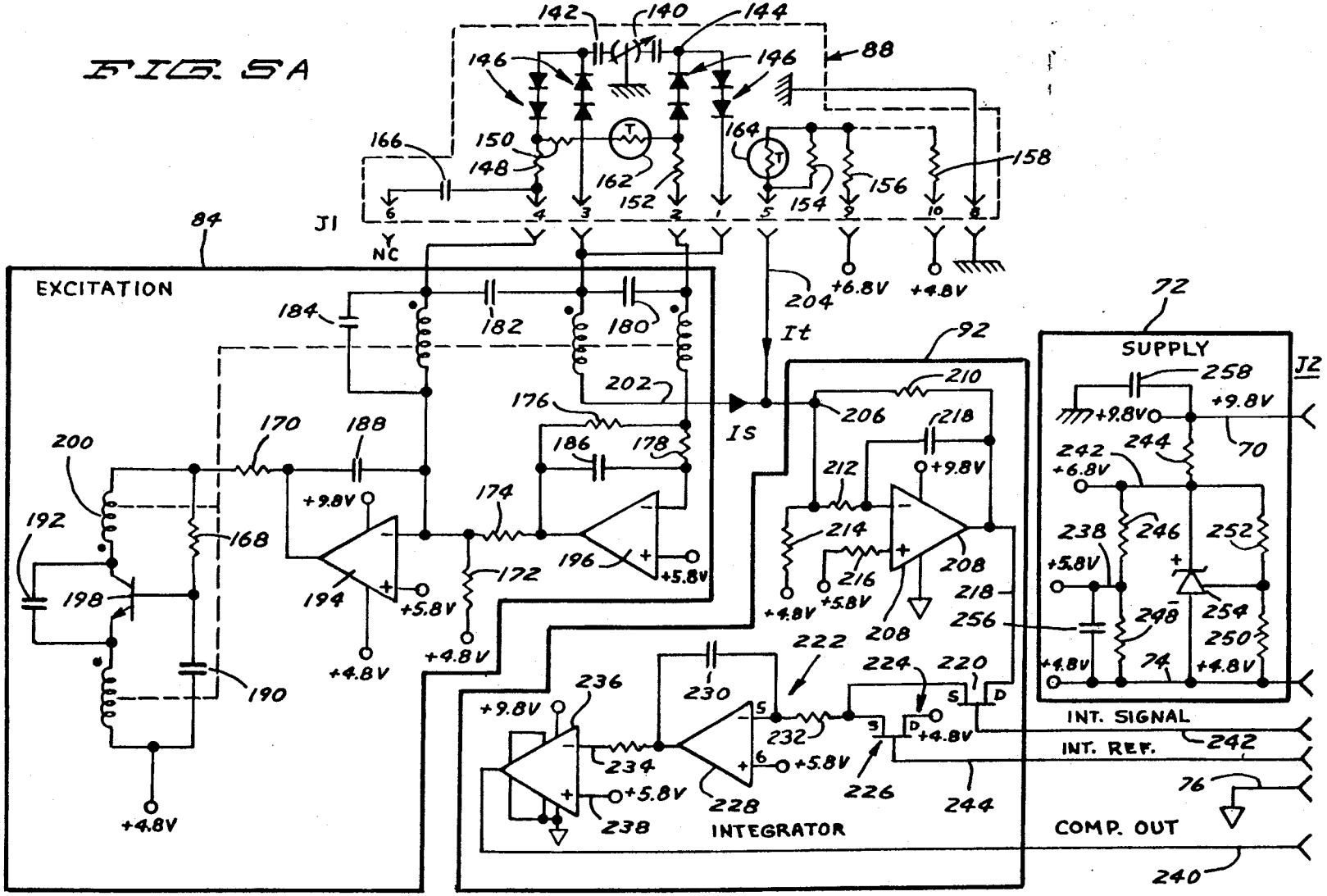
FIGS. 5A, 5B and 5C together provide a schematic diagram of a transmitter according to this invention.

In FIG. 5A, a first portion of circuitry of a transmitter is shown. A sensor module 88 is shown enclosed in a dashed line and comprises a capacitive pressure sensor 140 coupled through fixed capacitors 142, 144 to an array of rectification diodes 146. The rectification diodes 146 are coupled to an excitation circuit 84 which provides excitation to the capacitive pressure sensor 140 through the rectification diodes 146. The sensor module 88 further comprises selected fixed resistances 148, 150, 152, 154, 156, 158 and thermistors 162, 164 which are compensation components coupled together with sensor 140 and fixed capacitors 142, 144 to provide analog temperature compensation of the sensor 140. The sensor module 88 further comprises a correction capacitor 166 which was used with the former analog converter but which need not be connected to the digital converter and is not used.

The excitation means 84 comprises resistors 168, 170, 172, 174, 176, 178, capacitors 180, 182, 184, 186, 188, 190, 192, amplifiers 194, 196, transistor 198, and transformer 200 which has five windings coupled together for providing excitation. The operation of the excitation circuit in cooperation with the sensor module is substantially as described in U.S. Pat. No. 3,646,538 to Roger L. Frick.

The sensor module 88 couples a sensor current "Is" representative of the sensed pressure along line 202 to an integrator circuit 92. The sensor module 88 also couples an analog temperature compensation current "It" along line 204 to the integrator circuit 92. The sensor current "Is" and the temperature compensation current "It" are summed at node 206 of an amplifier stage comprising amplifier 208, resistors 210, 212, 214, 216 and capacitor 218. This amplifier stage provides a potential on line 218 which is representative of the sum of the currents (Is+It) and is thus representative of the sensor output corrected with the analog compensation circuitry of the sensor module. The line 218 is coupled through a switch (field effect transistor) 220 to an integrator stage 222. A substantially fixed reference potential is present on line 224 and is coupled through switch (field effect transistor) 226 to the integrator stage 222. The integrator stage 222 comprises an amplifier 228, a capacitor 230, and a resistor 232 coupled together as shown in FIG. 5A. The switches 220 and 226 are actuated alternately so that the integrator stage 22 alternately integrates the sensor potential and the fixed potential. The integrator stage 222 has an output on line 234 which is the time integral of the potentials applied by the switches 220, 226. The integrator stage output is coupled along line 234 to comparator 236 which compares the integrator output to a substantially fixed potential on line 238. The comparator output is coupled out on line 240 to circuitry in FIG. 5B which is explained later.

A portion of the supply circuitry, second regulator 72, is coupled between conductors 70 and 74 and generates intermediate supply potentials on lines 242 and 238 which supply reference potentials to the excitation and integrator circuits and temperature compensation circuitry in sensor module 88. The second regulator comprises resistors 244, 246, 248, 250, 252, and adjustable reference 254 and capacitors 256 and 258 coupled together as shown in FIG. 5A.

Figure 5B:
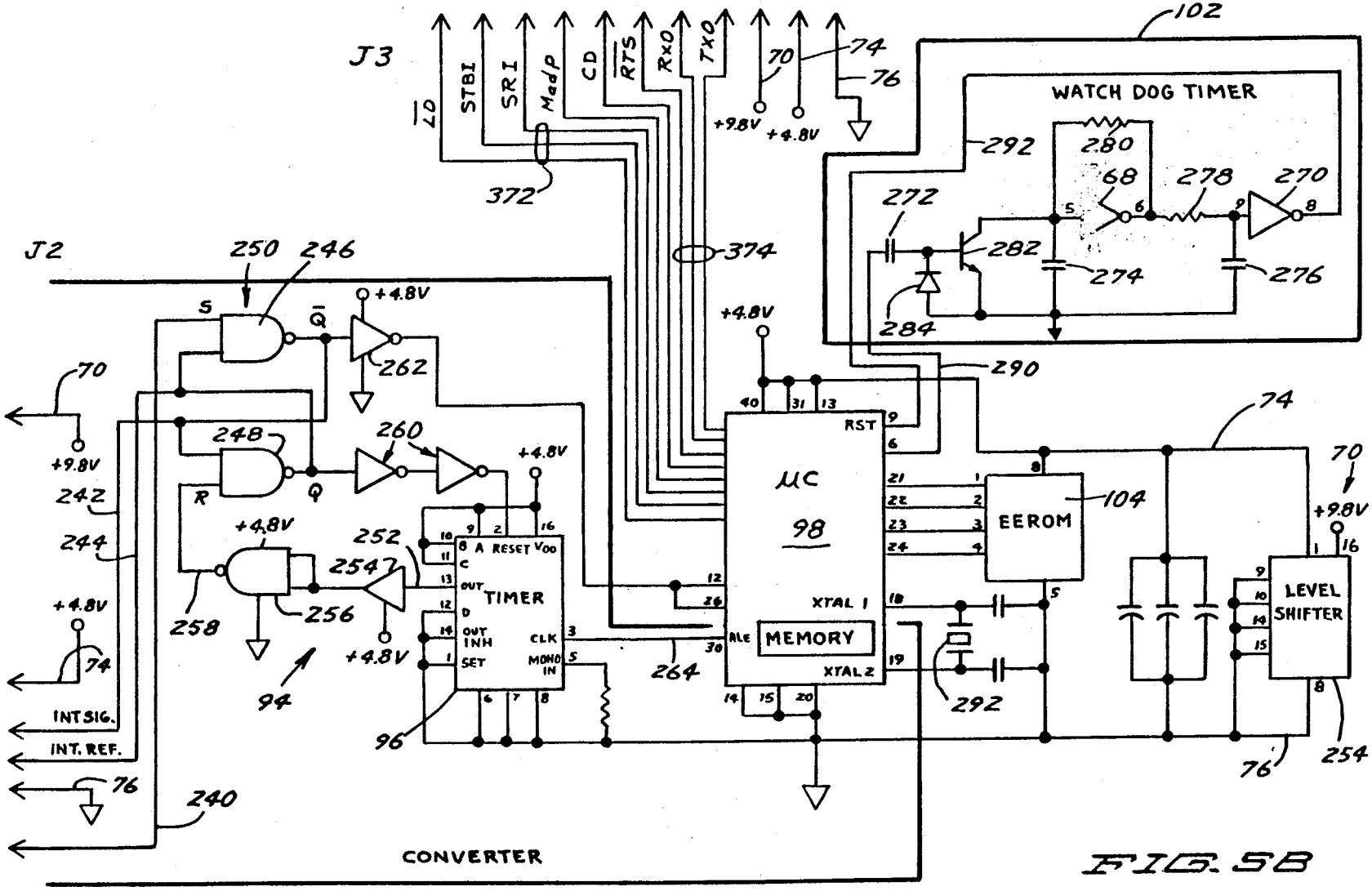

A connector indicated as "J2" in FIG. 5A mates with a connector likewise labeled "J2" in FIG. 5B.

In FIG. 5B, NAND gate 246 and 248 are coupled together to comprise a flip-flop circuit 250. The comparator output (FIG. 5A) is coupled along line 240 through connector J2 to a "set" input of flip-flop 250. A first output Q of flip-flop 250 is coupled along line 244 through connector J2 to the gate input of switch 226 (FIG. 5A). A second output $\overline{Q}$ of the flip-flop 250 is coupled along line 242 through connector J2 to the gate input of switch 220 (FIG. 3). Excitation potentials are coupled along lines 70, 74 and 76 through connector J2. A timer 96 provides a low level timer output on line 252 to a level shifting buffer 254 which provides a high level timer output to inverter 256. Timer 96 preferably comprises a part number CD 4536B manufactured by RCA Corporation. Inverter 256 couples the high level timer output to a reset input of the flip-flop 250 along line 258. The Q output of flip-flop 250 is coupled through buffers 260 to a reset input of the timer 96. The $\overline{Q}$ output of flip-flop 250 is coupled through inverter 262 to an input of microcomputer 98. Microcomputer 98 is preferably a part number 80C59 manufactured by OKI Semiconductor. The microcomputer 98 provides a clock signal along line 264 to the timer 96. The flip-flop 250, the timer 96 and the integrator 92 function together as a dual slope integrator circuit. The $\overline{Q}$ output of flip-flop 250 has a pulse width that is representative of the combined current (Is+It) and hence the signal coupled to the microcomputer 98 is representative of the sensed parameter, including the analog correction made in the sensor module 88. The microcomputer 98 counts its own clock pulses during this pulse width from inverter 262 to complete the analog-to-digital conversion of the sensor output (Is+It).

Watchdog timer 102 comprises inverters 268, 270, capacitors 272, 274, 276, resistors 278, 280, transistor 282 and diode 284 coupled together as shown in FIG. 5B. During the normal operation of microcomputer 98, the microcomputer 98 periodically provides a pulse on line 290 to the watchdog timer 102. The pulse on line 290 resets the watchdog timer 102 and prevents triggering the watchdog output on line 292. If, however, the microcomputer 98 malfunctions and fails to present a pulse on line 290 for a selected time interval set by the watchdog timer, the watchdog timer output on line 292 is triggered and resets the microcomputer 98 so that normal operation can be resumed. The selected time interval is a function of the resistances of resistors 280, 278 and the capacitances of capacitors 274, 276.

An electrically-eraseable-read-only-memory (EEROM) 104 is coupled to microcomputer 98 and stores digital words representative of digital corrections, span, zero and the like as explained in connection with FIG. 2. The microprocessor reads the correction constants stored in memory 104 and calculates corrections for the output as a function of the constants.

A crystal 292 is coupled to the microcomputer 98 to provide a stable clock or time reference.

While the operation of the transmitter is described with reference to a separate non-volatile memory 104, it will be understood by those skilled in the art that a portion of RAM in the microcomputer 98 may be energized by a battery to provide non-volatile storage of correction constants and the like. Lines 70, 74 and 76 are coupled to level shifter 254 to provide energization to it.

Figure 5C:
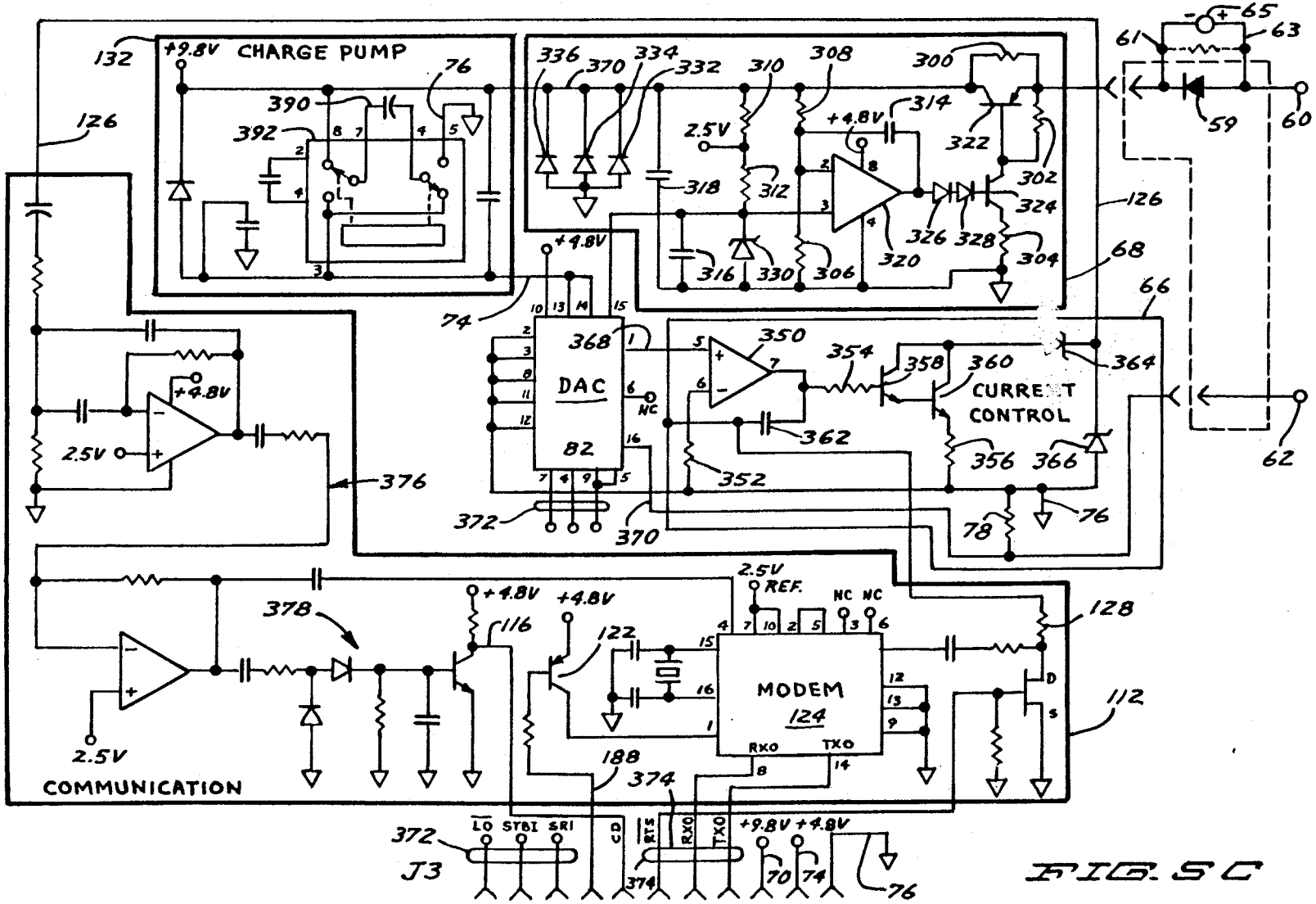

A connector labelled "J3" in FIG. 5B couples lines from the microcomputer 98 to circuitry shown in FIG. 5C. Supply lines 70, 74, 76 are also coupled through connector "J3" to circuitry in FIG. 5C.

In FIG. 5C, a connector labelled "J3" couples to the connector labelled "J3" in FIG. 5B and supply lines 70, 74, 76 are coupled through connectors J3 to the circuitry in FIG. 5B. The transmitter is coupled to the loop 14 through terminals 60, 62 in FIG. 5C. Current from loop 14 flows into the transmitter at terminal 60. Terminal 60 is coupled to a line 126 through a polarity protection diode 59. Meter terminals 61, 63 are coupled to diode 59 providing for connection of an optional indicating meter 65 in the wiring compartment 24 (shown in FIG. 2). A first regulator 68 is coupled to line 126 for receiving an excitation portion of the loop current from line 126. Regulator 68 supplies a first regulated potential to the line 70. The first regulator comprises resistors 300, 302, 304, 306, 308, 310, 312, capacitors 314, 316, 318, amplifier 320, transistor 322, 324, diodes 326, 328, and zener diodes 330, 332, 334 and 336 coupled together as shown in FIG. 5C for generating regulated potentials.

A current control circuit 66 is coupled between line 126 and terminal 62 for controlling the magnitude of current in the loop. The current control circuit 66 comprises an amplifier 350, resistors 78, 352, 354, 356, transistors 358, 360, capacitor 362 and zener diodes 364, 366 coupled together as shown in FIG. 5C for controlling current flow from line 126 to terminal 62. The amplifier receives a control input on line 368 and couples a current through resistor 354 to transistors 358, 360 which are arranged in a Darlington configuration. A portion of the loop current flows from line 126 through zener diode 364, transistors 358, 360 and resistor 356 to line 76. Current from further portions of transmitter circuitry flows into line 76 which is the circuit common line. Substantially all of the loop current thus flows from line 76 through resistor 78 to terminal 62 and back to the loop. A potential developed across resistor 78 is coupled along line 370 to DAC 82. The DAC 82 preferably comprises a part number AD7543 manufactured by Analog Devices. The DAC 82 compares the potential on line 370 to a calculated output signal received by the DAC from bus 372. Bus 372 is coupled from the DAC through connectors J3 to microcomputer 98 (shown in FIG. 5B).

A communication circuit 112 couples a communication output along line 128 to the current control for providing the first communication signal to the loop as explained in connection with FIG. 3. A second communication output is coupled from the loop at terminal 60 along line 126 to the communication circuit 112. The communication circuit 112 receives the second communication signal from line 126 and demodulates the second communication signal. The demodulated second communication signal is coupled along bus 374 through connector J3 to the microcomputer 98 (in FIG. 5B). The communication circuit 112 comprises a filter 376 for filtering and amplifying communication signals received from the loop. Filter 376 is coupled to a detector circuit 378 which detects presence of a carrier, and to a MODEM 124 which modulates and demodulates communication signals. The MODEM 124 preferably comprises a part number TCM3105 manufactured by Texas Instruments. The carrier detector 378 is coupled along line 116 through connectors J3 to microcomputer 98 (FIG. 5B). When a carrier is detected, the microcomputer 98 couples a signal along line 118 to a switch 122 which energizes MODEM 124.

A charge pump 132 is coupled between lines 70, 74 and 76. The charge pump preferably comprises a capacitor 390 coupled to a charge pump integrated circuit 392. Charge pump integrated circuit 392 preferably comprises a part number 7660 manufactured by Intersil. The capacitor 390 is charged from the lines 70, 74 and then discharged into lines 74, 76 such that current is balanced.

The apparatus can thus be configured to provided desired digital corrections to the output while the transmitter remains in place in the process plant. The cost of replacing the entire transmitter can be avoided while still acheiving an output which is digitally calculated to provide digital linearity correction. The transmitter can be fitted with the apparatus of this invention while the transmitter remains in place in the process installation. While the embodiments herein described have linear outputs, it will be understood by those skilled in the art that this invention can likewise be used with non-linear outputs such as square root outputs or with reverse acting outputs.

We claim:

1. A method for adding a capability to a parameter value transmitter for receiving input information where such a transmitter initially has, through a set of transmitting circuits therein, a capability for transmitting, along a two-wire current carrying loop adapted for electrical connection to first and second terminals of the transmitter, output information formed by those values measured by a sensing means in the transmitter of a parameter the values of which depend on conditions in a structure to which the transmitter is affixed, the method comprising:

disconnecting and removing at least a portion of the set of transmitting circuits which are initially electrically connected between the sensing means and the first and second terminals in the transmitter affixed to the structure; and providing in the transmitter affixed to the structure a set of transmitting and receiving circuits electrically connected between the sensing means and the first and second terminals, the set of transmitting and receiving circuits being capable of enabling the then-modified transmitter to simultaneously transmit the output information and to receive the input information.

2. The method of claim 1 wherein the transmission of the output information by the modified transmitter occurs through use of transmitted signals having a frequency content in a first frequency range, and wherein the reception of the input information by the modified transmitter occurs through receiving signals having a frequency content in a second frequency range separated from the first frequency range.

3. The method of claim 1 wherein the modified transmitter receives the input information and stores it therein at least temporarily.

4. The method of claim 1 wherein the sensing means comprises a sensor and sensor output signal correction circuitry, the sensor and the sensor output correction circuitry being sealed from that space in the transmitter in which the set of transmitting circuits were located before removal and from that space in the modified transmitter in which the set of transmitting and receiving circuits are provided.

5. The method of claim 1 wherein the modified transmitter provides a current between the first and second terminals on the two-wire current carrying loop of a value which has been adjusted based on the input information received at the first and second terminals.

6. The method of claim 2 wherein the transmitting and receiving circuits of the modified transmitter can also transmit information in the second frequency range.

7. The method of claim 2 wherein the modified transmitter provides a current between the first and second terminals on the two-wire current carrying loop of a value which has been adjusted based on the input information received at the first and second terminals.

8. The method of claim 3 wherein the input information stored is representative of span adjustment.

9. The method of claim 3 wherein the input information stored is representative of zero adjustment.

10. The method of claim 1 wherein the sensing means comprises a sensor which is sealed from that space in the transmitter in which the set of transmitting circuits were located before removal and from that space in the modified transmitter in which the set of transmitting and receiving circuits are provided, and wherein said structure contains a fluid therein both during said disconnecting and removing of at least a portion of the set of transmitting circuits and during the providing in the transmitter affixed to the structure of a set of transmitting and receiving circuits.

11. The method of claim 10 wherein said fluid is pressurized.

12. A method for adding a capability to a parameter value transmitter for transmitting a selected second kind of information where such a transmitter initially has, through a first set of transmitting circuits therein, a capability for a transmitting, along a two-wire current carrying loop adapted for electrical connection to first and second terminals of the transmitter, a first kind of information formed by those values measured by a sensing means in the transmitter of a parameter the values of which depend on conditions in a structure to which the transmitter is affixed, the method comprising:

disconnecting and removing at least a portion of the first set of transmitter circuits which are initially electrically connected between the sensing means and the first and second terminals in the transmitter affixed to the structure; and providing in the transmitter affixed to the structure a second set of transmitting circuits electrically connected between the sensing means and the first and second terminals, the second transmitting circuits being capable of enabling the then-modified transmitter to transmit both the first kind of information and the second kind of information simultaneously along the two-wire loop.

13. The method of claim 12 wherein the transmission of the first kind of information by the modified transmitter occurs through use of transmitted signals having a frequency content in a first frequency range, and wherein the transmission of the second kind of information by the modified transmitter occurs through use of transmitted signals having a frequency content in a second frequency range separated from the first frequency range.

14. The method of claim 12 wherein the sensing means comprises a sensor and sensor output signal correction circuitry, the sensor and the sensor output correction circuitry being sealed from that space in the transmitter in which the first set of transmitting circuits were located before removal and from that space in the modified transmitter in which the second set of transmitting circuits are provided.

15. The method of claim 12 wherein the sensing means comprises a sensor which is sealed from that space in the transmitter in which the first set of transmitting circuits were located before removal and from that space in the modified transmitter in which the second set of transmitting circuits are provided, and wherein said structure contains a fluid therein during said disconnecting and removing of at least a portion of the first set of transmitting circuits and during the providing in the transmitter affixed to the structure of a second set of transmitting circuits.

16. The method of claim 15 wherein said fluid is pressurized.

17. A parameter value transmitter having transmitting and receiving circuits therein for receiving input information signals and for transmitting, along a two-wire loop adapted for electrical connection to first and second terminals in the transmitter, values measured by a sensing means in the transmitter of a parameter the values of which depend on conditions in the structure to which the transmitter is affixed, the transmitter comprising:

three terminal means provided therein, including first and second terminal means electrically connected to the first and second terminals respectively; and the transmitting and receiving circuits provided therein comprising:

a power supply means capable of maintaining a differing voltage value on each of the three terminal means including first and second voltage values on the first and second terminal means, and a third voltage value on that third terminal means remaining which is intermediate the first and second voltage values, there being portions of the transmitting and receiving circuits electrically connected between the second and third terminal means capable of passing a greater total current therethrough than portions of the transmitting and receiving circuits electrically connected between the first and third terminal means; and a charge storage means having a pair of terminals and capable of being alternately electrically connected between the first and third terminal means with a selected one of the charge storage means terminals being connected to the third terminal means and then electrically connected between the second and third terminal means with the opposite charge storage means terminal being connected to the third terminal means.

18. The apparatus of claim 17 wherein the first terminal means is electrically connected to the first terminal through a voltage regulation circuit.

19. The apparatus of claim 17 wherein the second terminal means is electrically connected to the second terminal through a current sensing resistor.

20. The apparatus of claim 17 wherein the charge storage means is a capacitive means.

21. The apparatus of claim 17 wherein the transmitting and receiving circuits receive information signals at the first and second terminals.

22. The apparatus of claim 17 wherein the power supply means is capable of being operated from current supplied at the first and second terminals.

23. A method for adding a capability to a parameter value transmitter for receiving input information where such a transmitter initially has, through a set of transmitting circuits therein, a capability for transmitting, along a two-wire current carrying loop adapted for electrical connection to first and second terminals of the transmitter, output information formed by those values measured by a sensing means in the transmitter of a parameter the values of which depend on conditions in a structure to which the transmitter is affixed, the method comprising:

disconnecting and removing at least a portion of the set of transmitting circuits which are initially electrically connected between the sensing means and the first and second terminals in the transmitter affixed to the structure;

providing in the transmitter affixed to the structure a set of transmitting and receiving circuits electrically connected between the sensing means and the first and second terminals, the set of transmitting and receiving circuits being capable of enabling the then-modified transmitter to transmit the output information and to receive the input information;

providing electrical current to the transmitter through the two-wire current carrying loop which is substantially prevented in any part from flowing through at least one selected circuit component in the receiving circuits by a switch means in the absence of an information signal on the two-wire current carrying loop containing the input information;

detecting in the transmitter receipt of an information signal containing input information on the two-wire current carrying loop;

switching the switch means upon detection of the information signal to provide a flow of electrical current through the selected circuit components in the receiving circuits;

and switching the switch means again on termination of the detection of the information signal to thereby prevent flow of electrical current through the selected circuit components.

24. A method for adding a capability to a parameter value transmitter for transmitting a selected second kind of information where such a transmitter initially has, through a first set of transmitting circuits therein, a capability for transmitting, along a two-wire current carrying loop adapted for electrical connection to first and second terminals of the transmitter, a first kind of information formed by those values measured by a sensing means in the transmitter of a parameter the values of which depend on conditions in a structure to which the transmitter is affixed, the method comprising:

disconnecting and removing at least a portion of the first set of transmitter circuits which are initially electrically connected between the sensing means and the first and second terminals in the transmitter affixed to the structure;

providing in the transmitter affixed to the structure a second set of transmitting circuits electrically connected between the sensing means and the first and second terminals, the second transmitting circuits being capable of enabling the then modified transmitter to transmit both the first and second kinds of information along the two-wire loop;

providing electrical current to the transmitter through the two-wire current carrying loop which is substantially prevented in any part from flowing through at least one selected circuit component in the transmitting circuits by a switch means in the absence of a received signal on the two-wire current carrying loop;

selecting the second kind of information through a received signal selectively provided from an external source;

detecting in the transmitter receipt of a received signal on the two-wire current carrying loop;

switching the switch means upon detection of the received signal to provide a flow of electrical current through the selected circuit components in the transmitting circuit; and switching the switch means again on termination of the detection of the information signal to thereby prevent flow of electrical current through the selected circuit components.

* * * * *